United States Patent [19]

Motloch

[11] 4,211,426

[45] Jul. 8, 1980

[54] WEIGHT RELIEVING AMBULATOR

[75] Inventor: Wallace M. Motloch, Menlo Park, Calif.

[73] Assignee: Everest & Jennings, Inc., Los Angeles, Calif.

[21] Appl. No.: 929,651

[22] Filed: Jul. 31, 1978

[51] Int. Cl.[2] ..... A47D 13/04; A61H 3/04

[52] U.S. Cl. ..... 280/87.02 W; 297/5; 297/307; 272/70.3

[58] Field of Search ..... 280/87.02 W; 297/307, 297/274, 275, 5, 4; 272/70, 70.3, 114–117, 120, 134, 135, 137, 138, 144

[56] References Cited

U.S. PATENT DOCUMENTS

| | | | |
|---|---|---|---|
| 1,204,249 | 11/1916 | Condon, Jr. | 272/70.3 |
| 1,297,018 | 3/1919 | Scott | 272/70.3 |
| 3,066,906 | 12/1962 | Berlin | 297/274 X |

FOREIGN PATENT DOCUMENTS

| | | | |
|---|---|---|---|
| 90949 | 3/1954 | Fed. Rep. of Germany | 297/4 |
| 228611 | 9/1943 | Switzerland | 280/87.02 W |

*Primary Examiner*—John P. Silverstrim

*Assistant Examiner*—D. W. Underwood

*Attorney, Agent, or Firm*—Ralph B. Pastoriza

[57] ABSTRACT

The walker includes a frame structure mounted on rear wheels and forward casters in turn supporting a parallelogram structure lying essentially in a vertical plane. The rear ends of the upper and lower horizontal members making up the parallelogram structure are pivoted to a column extending upwardly from the frame structure and the front ends of these members are pivoted to a generally vertical front member supporting a harness. The arrangement is such that when the active lengths of the upper and lower horizontal members are equal, the front member will move up and down in essentially a vertical direction always remaining parallel to the upwardly extending column. A patient is supported in the harness structure to the front member and a force such as by springs is provided on the parallelogram structure to bias the front member upwardly and thereby relieve at least a part of the weight of a patient in the harness. This force is adjustable so that as a patient learns to walk the actual weight on the patient's legs can be adjusted to increase slowly as by decreasing the spring force applied to the parallelogram structure.

13 Claims, 8 Drawing Figures

WEIGHT RELIEVING AMBULATOR

BACKGROUND OF THE INVENTION

This invention relates generally to therapeutic type ambulating devices and more particularly to an improved weight relieving ambulator for helping and/or teaching patients, particularly children, to walk.

Various types of ambulators or walkers as they are sometimes referred to, are well known in the art. Some of these known structures incorporate hydraulic cylinder arrangements to raise an overhead arm supporting a patient to thereby relieve some of the weight of the patient. Others employ pivoted arm structures connected to a jacket or harness for supporting the patient.

Various problems arise with respect to the foregoing prior art structures, particularly in the case of children. First, the structures are relatively complicated and in the case of employing telescoping cylinders, binding can occur and thus frustrate the desired weight control action on the patient. Second, harness structures employed do not always support the patient in a secure manner to the control elements of the ambulator and yet permit sufficient freedom for the patient to move about. If prior art type harness structures are too restrictive in an attempt to properly secure the patient, movements of the patient are unnecessarily restricted, thus inhibiting the desire for the patient to learn to walk. The problem is particularly acute with small children wherein it would be desirable to provide as much freedom of movement as possible, particularly for the arms and hands of a child, so that they are free to explore, and yet provide the proper weight control on the child's legs.

Any such type of weight relieving ambulator should be so designed that no portion of the structure extends higher than the patient's head to the end that the patient can pass through low overhead doors, passages and the like.

Finally, any such weight relieving ambulator device should be completely adjustable so that it can readily be adapted to any sized patient. In this respect, a most important adjustment is the range over which the weight of the patient can be relieved. A not uncommon childhood disease known as osteo-genesis imperfecta (brittle bones) results in great difficulty in a child learning to walk. An ambulator of the type under consideration should be capable of relieving up to 90% of the child's weight and yet be adjustable so that progressively greater weight of the child can be on its legs until finally the full weight of the child is borne by the child's legs.

BRIEF DESCRIPTION OF THE PRESENT INVENTION

Bearing all the foregoing considerations in mind, the present invention contemplates the provision of a vastly improved weight relieving type ambulator particularly suitable for children which overcomes the foregoing problems and exhibits the various desirable features heretofore set forth.

More particularly, in accord with the present invention, rather than hydraulic systems, overhead suspended harnesses, and the like, a simple but highly effective parallelogram structure is employed for supporting the patient and providing the weight relieving control.

Briefly, the ambulator includes a wheel supported frame; a body supporting harness; a parallelogram structure lying essentially in a vertical plane having rear and front portions connected to the frame and supporting harness, respectively; and force providing means for applying a lifting force on the front portion of the parallelogram structure to oppose the downward weight of a patient held in the supporting harness and thereby relieve at least a part of the weight of the patient on the patient's legs to facilitate walking by the patient.

BRIEF DESCRIPTION OF THE DRAWINGS

A better understanding of this invention as well as further features and advantages thereof will be had by now referring to the accompanying drawings in which.

DETAILED DESCRIPTION OF THE PREFERRED EMBODIMENT

Figure 1:
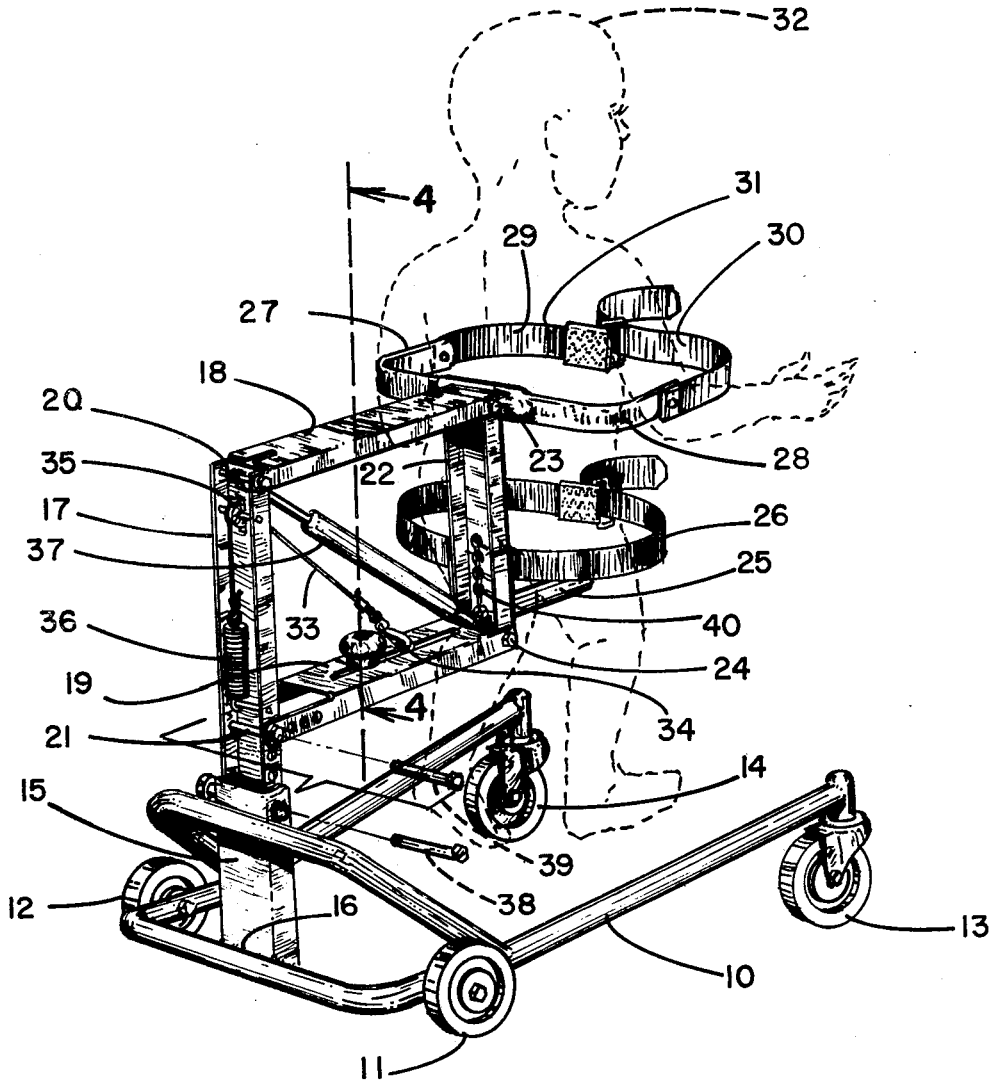
FIG. 1 is a three-quarter rear perspective view of the weight relieving ambulator of this invention wherein a child is depicted in phantom lines supported by the ambulator.

Referring to the lower right portion of FIG. 1, the weight relieving ambulator includes a base frame 10 having rear wheels 11 and 12 and front casters 13 and 14 for rolling along a floor. An upwardly extending column means includes a base column 15 rigidly secured to the frame 10 as by welding as indicated at 16. A telescoping column 17 in turn extends upwardly from within the base column 15 as shown.

A parallelogram structure is defined by upper and lower generally horizontal channel members 18 and 19 pivoted at their rear ends to the telescoping column 17 as indicated at 20 and 21, and a generally vertical front member 22 pivoted at its upper and lower ends to the forwardly extending ends of the upper and lower horizontal members as indicated respectively at 23 and 24.

With the foregoing arrangement, and with the active lengths of the upper and lower horizontal members 18 and 19 equal, the front member 22 can move generally in a vertical up and down direction remaining essentially parallel to the telescoping column 17.

A harness structure for supporting a patient is secured to this front member 22 and takes the form of a crotch supporting projection 25 extending forwardly from a lower portion of the front member 22 and terminating in a cross bar 26. This crotch supporting means is arranged to extend under and support the crotch area of a patient, the cross bar 26 extending transversely in front of the upper thigh portions of the patient to prevent accidental forward slipping off of the projection 25 and yet minimize any inhibition of movement of the patient's legs.

The harness structure further includes a torso supporting means in the form of left and right arm members 27 and 28 extending forwardly from an upper portion of the front member 22 as shown. The extending ends of these arm members connect to suitable straps 29 and 30 which may be passed about the front torso portion of a patient and secured in overlapping relationship as by means of "VELCRO" indicated at 31.

In accord with a feature of this invention, the arm portions 27 and 28 may be made of thin mild steel capable of being manually bent so as to engage snugly under the arms and about the torso of the patient such that the patient is held in general alignment with the front member 22 with the patient's legs engaging the floor area between the rear wheels and front casters. This orientation of the patient is indicated by the phantom lines 32 depicting a small child held in the harness structure. p The weight relieving control of the ambulator of FIG. 1 is effected by a force providing means positioned to exert a force between points adjacent to two diagonally opposite vertices of the parallelogram structure tending to collapse the parallelogram structure in a direction resulting in an upward force raising the front member 22 relative to the telescoping column 17. In the particular embodiment illustrated in FIG. 1, this force providing means takes the form of spring means including a tension line 33 connected at a point 34 adjacent to the front lower pivot 24 defining the front lower vertex of the parallelogram structure. The line 33 passes diagonally within the parallelogram structure over a pulley 35 in turn secured at a point adjacent to the rear upper pivot 20 defining the rear upper diagonally opposite vertex of the parallelogram structure. The end of the line 33 after passing over the pulley 35 connects to powerful springs 36 the lower ends of which are anchored to the telescoping column 17 as illustrated.

The spring means described thus applies a tension force between points adjacent the two diagonally opposite vertices defined at the pivot points 24 and 20 of the parallelogram structure and it will be evident that this tension force will tend to collapse the parallelogram structure in a manner to raise the front member 22. This upward force applied to the front member 22 opposes the weight of the patient 32 such that the weight of the patient on the patient's legs engaging the floor is relieved by the amount of the upward force.

The use of a harness supported by the parallelogram structure as described has many important advantages. First, the pivoting of the various members making up the parallelogram provides a linkage arrangement which is of extremely low friction so that the front member is almost in a "floating" condition insofar as vertical movement is concerned. On the other hand, lateral movement is minimized with respect to the telescoping column member 17 and frame structure by the use of relatively wide channel members making up the structure. Thus, lateral turning takes place by movement of the casters and entire frame structure. Moreover, the harness attachment to the front member 22 is such that the child is secured in alignment with this member and essentially becomes "a part of the mechanism". In other words, the parllelogram linkage arrangement together with the force applying means providing the weight relieving feature "follows" the child as though the walker were a part of the child's body.

As mentioned heretofore in utilizing the device as a therapeutic structure or simply as a device to aid in rehabilitation of the walking of a patient, it is important to be able to adjust the percentage of the patient's weight relieved. Thus, as the patient improves and the patient's muscles develop, less and less of the patient's weight should be relieved in appropriate steps so that eventually the full weight of the patient will be borne by the patient's legs. An appropriate adjustment means is provided in the ambulator of this invention enabling relieving the patient's weight over a range of at least from 25–75% of the patient's weight and preferably from 10–90%.

This adjustment, which will subsequently be described in detail, is effected by changing the distance of the point of connection of the tension line 33 of the spring means from the lower front vertex at the pivot point 24. Maximum weight relieving force results when this point of connection 34 is closest to the lower front vertex or pivot point 24 of the parallelogram structure and least when the point of connection 34 is furthest away from this vertex.

With respect to the foregoing, the adjustment of the weight relieving force is compound in nature. First, movement of the connection point 34 rearwardly away from the pivot point 24 shortens the overall extent of the tension line 33 between its point of connection 34 and the pulley 35 thereby permitting some collapsing of the springs 36 so that their applied force is decreased. Secondly, movement of the connection point 34 rearwardly away from the pivot point 24 effectively increases the "lever arm" between the point of connection and the pivot point resulting in less actual lifting force on the front member 22 for an equivalent tension applied in the line 33 prior to movement of the point 34.

From the foregoing, it can thus be appreciated that a large variation in the relieved weight can be effected for fairly small movements of the attachment point 34 of the tension line 33.

When the patient is walking in the ambulator, the front member 22 will be subject to fairly small up and down movements so that the upward relieving force remains fairly constant throughout such movement. On the other hand, should the patient's legs collapse resulting in a fairly large downward movement of the front member, the relieving force will increase because of the extension of the tension line 33 pulling against the powerful springs 36. This extension of the line 33 results from the parallelogram structure wherein the lower front and upper rear vertices move further apart as the parallelogram collapses. The increase in the weight relieving force will be sufficient to prevent injury to the child should the child's legs collapse.

To avoid any undue oscillation during normal walking, the preferred embodiment of the ambulator contemplates the provision of a simple damping cylinder and piston arrangement as indicated at 37 extending between two diagonally opposite vertices of the parallelogram structure. In certain designs wherein the ambulator is to be used with very small children thereby not necessitating a large weight relieving force the force providing means may take the form of a spring within the piston cylinder structure 37 urging the piston in a given direction. In the structure of FIG. 1, this direction would be such as to provide tension between the connecting pivot points 24 and 20 between which the cylinder and piston structure 37 is mounted. Alternatively, a combination of a spring in the damping cylinder together with the spring means comprised of the tension line 33 and powerful springs 36 may be used.

Still referring to FIG. 1, further adjustment means are illustrated. For example, the telescoping extent of the telescoping column 17 from the base column 15 can readily be adjusted as by means of a locking pin illustrated in phantom lines in exploded position at 38 receivable within an opening in the base column 15 for registration with one of several vertically provided openings in the telescoping column 17. This adjustment enables adjustment of the height of the parallelogram structure above the floor so that the ambulator can readily be adapted to children of different heights.

Another adjustment means depicted in FIG. 1 comprises varying the active or effective length of the lower horizontal member 19 of the parallelogram structure. Towards this end, the pivot pin 21 can be removed to the phantom line position illustrated at 39 and the pivoting of the rear end of the lower horizontal member 19 changed by sliding this member rearwardly and reinserting the pivot pin in one of a series of auxiliary pivot holes as illustrated. The purpose for this particular adjustment will be described in detail subsequently.

Finally, there is illustrated in FIG. 1 a series of vertical openings 40 in the front member 22 into any one of which the crotch supporting projection 25 may be secured to thereby vary the distance between the crotch supporting member 25 and the torso supporting means in the forms of the arms 27 and 28. This latter adjustment as in the case of the adjustment of the overall height of the parallelogram structure above the floor permits ready adaptation of the ambulator to any particular sized patient.

Figure 2:
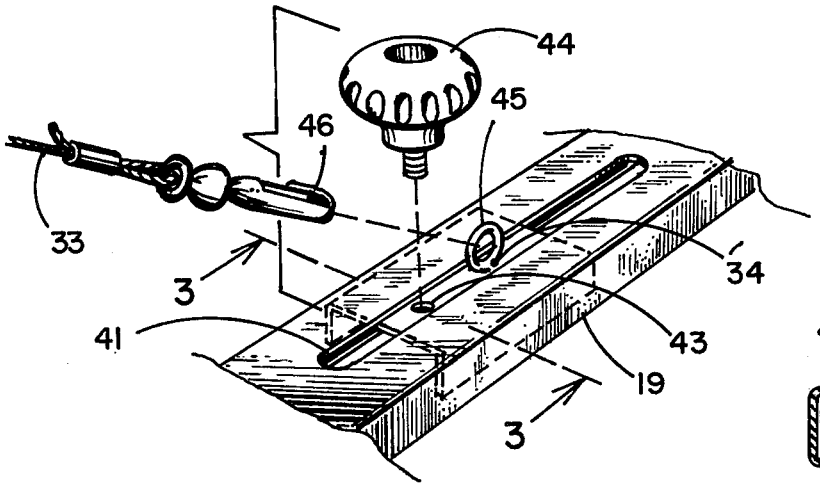
FIG. 2 is an enlarged fragmentary exploded perspective view of an adjustable portion of the ambulator of FIG. 1.

Referring now to FIG. 2, one means of effecting the adjustment for the weight relieving force by shifting the point of attachment 34 of the tension line 33 is illustrated. As shown in FIG. 2, the lower horizontal member 19 is provided with a slot 41. A slide plate 42 in turn is arranged to ride beneath this slot and includes a threaded opening 43 receiving a threaded knob 44. Also provided is a ring 45 at the point of attachment 34 for connection to the end of the tension line 33. Towards this end, the end of the tension line 33 may include a simple clasp structure 46 for easy manual connection and disconnection of the tension line to the ring 45.

Figure 3:
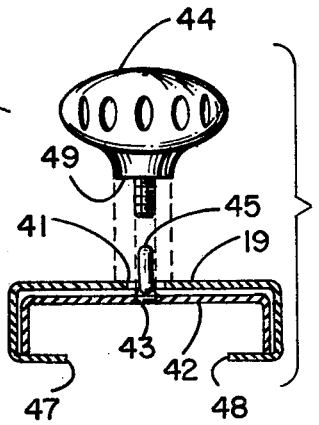
FIG. 3 is an exploded cross section taken in the direction of the arrows 3—3 of FIG. 2.

FIG. 3 illustrates the structure of FIG. 2 in cross section wherein it will be noted that the lower sides of the horizontal channel member 19 have inwardly turned flange portions 47 and 48 to serve as rail supports for the slide plate 42. Further, it will be noted that the underside of the knob 44 is of sufficient dimension to define a flat engaging surface 49 which will engage the peripheral edges of the slot 41 so that upon threading of the knob 44 tightly within the threaded opening 43, the slide plate 42 will be locked to the underside of the horizontal member 19 in any set longitudinal position.

In FIG. 2, there is shown an arbitrary scale of divisions denoting the particular position of the slide plate so that a point of attachment may be consistently relocated by noting the index marks.

The foregoing arrangement provides an infinite number of adjustments for the point of attachment of the tension line and thus provides for a means of changing the weight relieving force in a continuous manner as opposed to a change in discrete steps.

Figure 4:
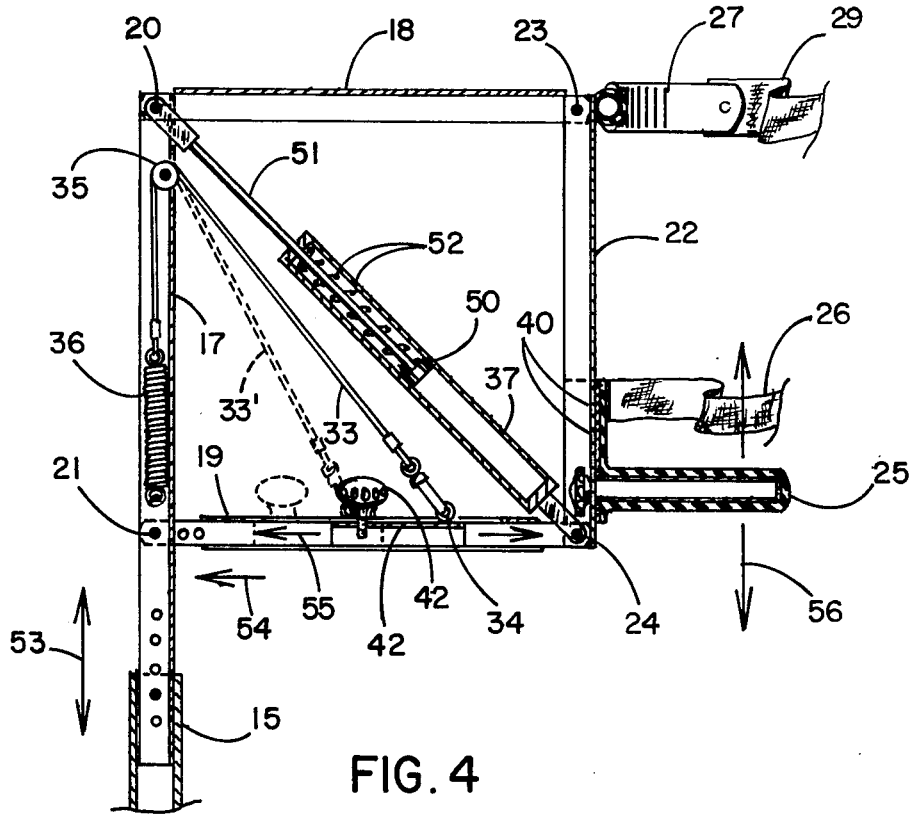
FIG. 4 is a side view in cross section looking in the direction of the arrows 4—4 of the ambulator of FIG. 1.

Referring now to the side cross section of FIG. 4, there is illustrated in greater detail the damping cylinder 37 wherein it will be noted there is provided a piston head 50 connected to piston rod 51 and a spring 52 biasing the piston rod and head further into the cylinder thereby applying a tension force between the diagonally opposite vertices defined by the pivot points 24 and 20 of the parallelogram structure. As mentioned heretofore, where only a fairly small weight relieving force is required, this spring 52 could be adequate so that the spring means in the form of the tension line 33 and powerful springs 36 together with the pulley 35 could be omitted. However, in the preferred embodiment, the powerful springs 36 would be used together with the adjustment means described and optionally a further spring 52 may or may not be provided in the damping cylinder 37.

With respect to the damping operation itself, the cylinder and piston function in a manner similar to a simple door dampener, air passing from one side of the piston head to the other through appropriate bleed openings. Of course, any equivalent type of damping structure could be used.

The various adjustments described with respect to FIG. 1 are schematically illustrated in FIG. 4 as by means of various arrows. Thus, the height adjustment of the parallelogram structure by means of the telescoping columns is indicated by the double-headed arrow 53. Adjustment of the effective length of the lower horizontal member 19 defined between its pivot points 24 and 21 as by shifting of the pivot point 21 is indicated by the arrow 54.

Adjustment of the weight relieving force by shifting the attachment point 34 of the tension line 33 is depicted by the arrow 55 and phantom line showing of the tension line 33 as at 33'.

Finally, adjustment of the crotch supporting projection 25 relative to the torso supporting arms is indicated by the arrow 56.

Figure 5:
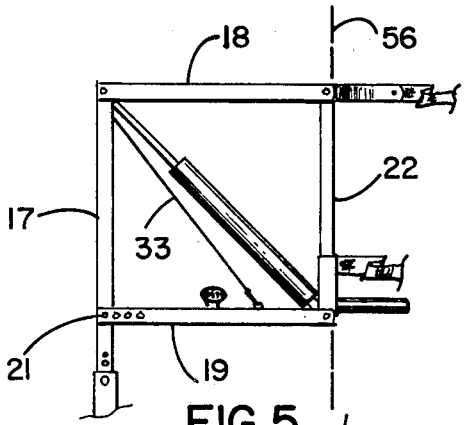
FIG. 5 is a side elevation schematic in form of the ambulator in a first position.
Figure 6:
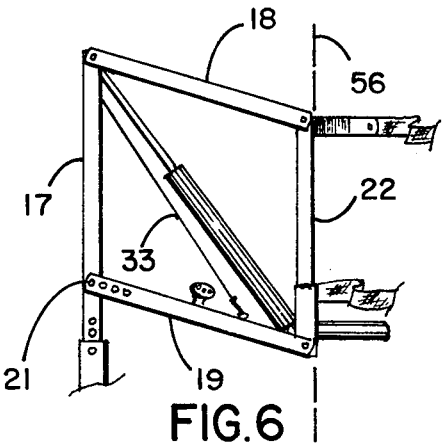
FIG. 6 illustrates the ambulator of FIG. 5 in a second position.

FIGS. 5 and 6 illustrate the action of the parallelogram structure when the effective lengths of the upper and lower horizontal channel members 18 and 19 are equal. In this instance, the front member 22 will be essentially vertical as indicated by the vertical dash line 57 in FIG. 5.

Referring to FIG. 6, when the front member 22 moves downwardly slightly when a patient is walking, the harness structure and front member 22 will still remain essentially vertical as indicated by the vertical dash line 57'.

Figure 7:
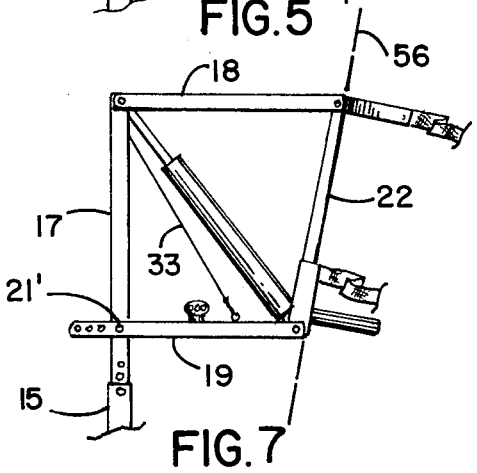
FIG. 7 is another side elevation of the ambulator in a first position after one of several adjustments has been effected; and, FIG. 8 illustrates the ambulator of FIG. 7 in a second position illustrating the effects of the adjustment.

In some instances, it may be desirable to tilt the patient slightly in a forward direction as the patient is learning to walk. Towards this end, the adjustment of the effective length of the lower horizontal member 19 is provided. Thus, referring to FIG. 7 the rear pivot point is shifted to 21' to thereby decrease the effective length of the lower horizontal member 19. This shifting of the pivot point will cause a very slight tilt of the front member 22 as depicted by the dash line 58 in FIG. 7.

Figure 8:
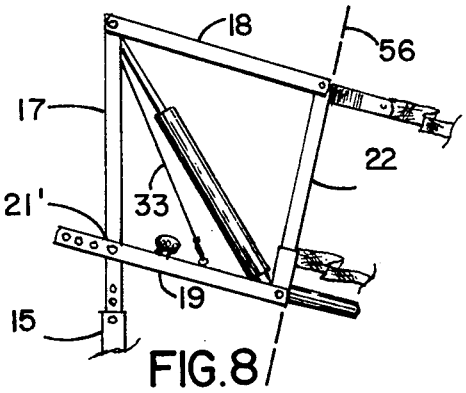

Referring to FIG. 8, when the parallelogram structure moves downwardly as shown, the tilt of the front member 22 will increase as indicated by the dash line 58'. This increase in the tilt is a consequence of the shifting of the pivot point to the position 21' of the lower horizontal member 19. It should be understood that an increase in the forward tilt from the dash line 58 of FIG. 7 will also occur when the front member 22 moves upwardly as a result of the pivot point adjustment of the lower horizontal member 19.

From all of the foregoing, it will be evident that the present invention has provided a greatly improved weight relieving ambulator particularly for children. Not only is any "binding" of the movable parts avoided as a consequence of the use of a parallelogram structure but in addition, there is avoided any overhead pivot arms or structures which could interfere with low doors and the like. The front caster wheels in combination with the rear wheels permits easy ambulation in any direction by a patient secured in the harness. Moreover, and as already fully described, the adjustment of the amount of weight relieving afforded by the ambulator results in a device extremely useful for therapeutic purposes as well as for simple training or retraining in walking.

Various minor changes falling within the scope and spirit of this invention will occur to those skilled in the art. The weight relieving ambulator accordingly is not to be thought of as limited to the precise construction shown merely for illustrative purposes.

I claim:

1. A weight relieving ambulator for aiding a patient to walk including, in combination:

(a) a wheel-supported frame;

(b) a body supporting harness;

(c) a parallelogram structure lying essentially in a vertical plane having rear and front portions connected to said frame and supporting harness respectively; and (d) force providing means providing a tension force between points adjacent to the upper rear and lower front vertices of said parallelogram structure for applying a lifting force on the front portion of said parallelogram structure to oppose the downward weight of a patient held in said supporting harness and thereby relieve at least a part of the weight of the patient on the patient's legs to facilitate walking by the patient.

2. An ambulator according to claim 1, in which said force providing means includes a spring means.

3. An ambulator according to claim 2, including means for shifting the point of connection of said spring means adjacent to the lower front vertex of said parallelogram structure to positions closer to or further from said vertex to thereby vary said lifting force to adapt said ambulator to the physical condition of a patient using the same.

4. A weight relieving ambulator for aiding a patient to learn to walk including, in combination:

(a) a base frame having rear wheels and front casters for rolling along a floor and an upwardly extending column means adjacent to the rear wheels;

(b) a parallelogram structure defined by upper and lower generally horizontal members pivoted at their rear ends to said column means, and a generally vertical front member pivoted at its upper and lower ends to the forwardly extending ends of said upper and lower horizontal members respectively;

(c) a crotch supporting means extending forwardly from a lower portion of said front member to extend under and support the crotch area of a patient;

(d) a torso supporting means in the form of left and right arm members extending forwardly from an upper portion of said front member to engage under the arms and about the torso of said patient so that said patient is held in general alignment with said front member with the patient's legs engaging the floor area between the rear wheels and front castors; and (e) force providing means positioned to exert force between points adjacent to two diagonally opposite vertices of said parallelogram structure tending to collapse said parallelogram structure in a direction resulting in upward force raising said front member relative to said column means, the weight of said patient opposing said upward force on said front member, whereby the weight of said patient on the legs of the patient when engaging the floor is relieved by the amount of said upward force thereby facilitating walking by the patient.

5. An ambulator according to claim 4, including means for adjusting the force provided by said force applying means so that said upward force can be adjusted to relieve the weight of said patient over a range of at least 25–75% of the patient's actual weight.

6. An ambulator according to claim 4, in which said column means includes a base column rigidly secured to said base frame and a telescoping column extending upwardly from said base column, the rear ends of said upper and lower horizontal members of said parallelogram structure being pivoted to said telescoping column; and means for securing said telescoping column at desired vertical telescoped positions in said base column to thereby enable adjustment of the height of the parallelogram structure above the floor.

7. An ambulator according to claim 4, including means for adjusting the vertical position of said crotch supporting means relative to the lower end of said front member to thereby enable the distance between said crotch supporting means and torso supporting means to be adjusted.

8. An ambulator according to claim 4, including a damping cylinder and piston connected between two diagonally opposite vertices of said parallelogram structure to dampen motion of said parallelogram structure as a patient walks.

9. An ambulator according to claim 8, in which said force applying means includes spring means in said damping cylinder biasing said piston in a given direction.

10. An ambulator according to claim 5, in which said force applying means comprises spring means, said means for adjusting the force of said force applying means including means for varying the distance of the point of attachment of one end of said spring means from the adjacent vertex.

11. An ambulator according to claim 10, including a damping cylinder and piston connected between two diagonally opposite vertices of said parallelogram structure to dampen motion of said parallelogram structure as a patient walks.

12. An ambulator according to claim 4, including means for changing the rear pivoting point of said lower member to said column means to effectively shorten the active length of said lower horizontal member and thereby introduce a forward tilt to said generally vertical front member as it moves up and down as a result of motion of said parallelogram structure.

13. An ambulator according to claim 4, in which said left and right arms of said torso supporting means include at least, in part, bendable metal portions to permit manual shaping of the support to a patient's torso to assure secure support of the patient to said front member.

* * * * *

Disclaimer 4,211,426.—*Wallace M. Motlich,* Menlo Park, Calif. WEIGHT RELIEVING AMBULATOR. Patent dated July 8, 1980. Disclaimer filed May 17, 1984, by the assignee, *Everest & Jennings, Inc.*

Hereby enters this disclaimer to claims 1, 2, 3, 4, 5 and 10 of said patent.

[*Official Gazette July 3, 1984.*]